US010053806B2

(12) United States Patent
Takahata et al.

(10) Patent No.: US 10,053,806 B2
(45) Date of Patent: Aug. 21, 2018

(54) SEWING MACHINE AND RECORDING MEDIUM STORING PATTERN DATA PROCESSING PROGRAM

(71) Applicant: BROTHER KOGYO KABUSHIKI KAISHA, Nagoya-shi, Aichi-ken (JP)

(72) Inventors: Hirotsugu Takahata, Nagoya (JP); Chiyo Koga, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 15/467,566

(22) Filed: Mar. 23, 2017

(65) Prior Publication Data

US 2017/0191199 A1 Jul. 6, 2017

Related U.S. Application Data

(63) Continuation of application No. PCT/JP2016/054708, filed on Feb. 18, 2016.

(30) Foreign Application Priority Data

Feb. 27, 2015 (JP) ..... 2015-038298

(51) Int. Cl.

| | |
|---|---|
| ***D05C 5/02*** | (2006.01) |
| ***D05B 19/10*** | (2006.01) |
| ***D05B 19/12*** | (2006.01) |
| ***D05C 5/04*** | (2006.01) |

(52) U.S. Cl.

CPC ..... *D05B 19/10* (2013.01); *D05B 19/12* (2013.01); *D05C 5/04* (2013.01)

(58) Field of Classification Search

CPC ..... D05B 19/02; D05B 19/04; D05B 19/06; D05B 19/08; D05B 19/10; D05B 19/12; D05C 5/04; D05C 5/06

USPC ..... 700/136–138

See application file for complete search history.

(56) References Cited

U.S. PATENT DOCUMENTS 5,355,319 A * 10/1994 Matsubara ..... D05B 19/10 112/102.5
5,771,826 A * 6/1998 Hirata ..... D05B 19/06 112/102.5
5,775,240 A * 7/1998 Hara ..... D05B 19/08 112/102.5

(Continued)

*Primary Examiner* — Nathan Durham
(74) *Attorney, Agent, or Firm* — Oliff PLC

(57) ABSTRACT

A sewing machine that includes a storage unit to store a plurality of pieces of pattern data respectively corresponding to a plurality of embroidery patterns and is capable sewing an embroidery pattern on a work cloth on the basis of the pattern data, the sewing machine includes a controller to control the sewing machine to: select one piece of pattern data from the pattern data stored in the storage unit; extract a plurality of pieces of other pattern data from the pattern data stored in the storage unit randomly; generate images of a plurality of combined embroidery patterns as a combination of a plurality of embroidery patterns respectively corresponding to the plurality of pieces of other pattern data extracted by extracting and an embroidery pattern corresponding to the one piece of pattern data selected; and display the images of the combined embroidery patterns generated by the generating on a display.

12 Claims, 15 Drawing Sheets

(56) References Cited

U.S. PATENT DOCUMENTS

| | | | | | |
|---|---|---|---|---|---|
| 5,803,000 | A * | 9/1998 | Morita | D05B 19/105 | 112/102.5 |
| 5,894,294 | A * | 4/1999 | Morita | D05B 19/085 | 345/157 |
| 5,924,372 | A * | 7/1999 | Okuda | D05B 19/10 | 112/102.5 |
| 6,006,686 | A * | 12/1999 | Hamajima | D05B 19/105 | 112/102.5 |
| 2006/0048690 | A1* | 3/2006 | Whitten | D05C 15/34 | 112/475.01 |
| 2007/0199492 | A1* | 8/2007 | Ishii | D05B 19/10 | 112/303 |
| 2011/0107950 | A1* | 5/2011 | Takahata | D05B 19/10 | 112/80.23 |
| 2012/0197430 | A1* | 8/2012 | Maki | D05B 19/12 | 700/138 |
| 2013/0035779 | A1* | 2/2013 | Ihira | D05C 5/04 | 700/138 |
| 2013/0036957 | A1* | 2/2013 | Kato | D05B 19/12 | 112/102.5 |
| 2013/0041496 | A1* | 2/2013 | Maki | D05C 5/04 | 700/138 |
| 2013/0079915 | A1* | 3/2013 | Ihira | D05C 5/02 | 700/138 |
| 2013/0079916 | A1* | 3/2013 | Okuyama | D05C 5/02 | 700/138 |
| 2016/0010252 | A1* | 1/2016 | Yamanashi | D05B 19/10 | 700/138 |

* cited by examiner

SEWING MACHINE AND RECORDING MEDIUM STORING PATTERN DATA PROCESSING PROGRAM

CROSS-REFERENCE TO RELATED APPLICATION

This application is a continuation application of International Application No. PCT/JP2016/054708, filed on Feb. 18, 2016, which claims priority from Japanese Patent Application No. 2015-038298, filed on Feb. 27, 2015. The disclosure of the foregoing application is hereby incorporated by reference in its entirety.

FIELD

The present disclosure relates to a sewing machine capable of sewing an embroidery pattern on a work cloth on the basis of pattern data, and a recording medium storing a pattern data processing program for processing pattern data.

BACKGROUND

A sewing machine that is capable of sewing an embroidery pattern and includes a stitch forming mechanism including a needle, a transfer mechanism for causing an embroidery frame that holds a work cloth to move in two directions, i.e., an X-direction and a Y-direction, on a sewing machine bed, and a control device for controlling the stitch forming mechanism and the transfer mechanism has been conventionally known. In this sewing machine, the control device controls driving of each of the stitch forming mechanism and the transfer mechanism on the basis of pattern data, which indicates amounts of movement in the X-direction and Y-direction of the embroidery frame for each stitch, thereby executing a sewing operation for sewing an embroidery pattern of a pattern corresponding to the pattern data on the work cloth.

In the sewing machine of a related art, a storage device is provided and the storage device stores a plurality of pieces of pattern data. A user can use a data selection device to select a plurality of embroidery patterns (pattern data) such as one-point patterns of "yacht" and "tulip".

SUMMARY

Incidentally, when a plurality of embroidery patterns is selected and embroidery sewing is performed using combinations of the embroidery patterns, similar combinations tend to be used every time the same user performs an operation, and thus it is considered that the same type of design of patterns tends to be selected. Accordingly, there is a demand for obtaining combinations of embroidery patterns of various designs so that the range of expression of embroidery can be expanded.

The present disclosure has been made in view of the above-mentioned circumstances, and an object of the present disclosure is to provide a sewing machine capable of forming embroidery patterns of various designs when embroidery sewing is performed using combinations of a plurality of embroidery patterns, and a recording medium storing a pattern data processing program.

In order to attain the above-mentioned object, one aspect of the present disclosure is a sewing machine that includes a storage unit configured to store a plurality of pieces of pattern data respectively corresponding to a plurality of embroidery patterns and is capable sewing an embroidery pattern on a work cloth on the basis of the pattern data, the sewing machine comprising: a controller, the controller being configured to control the sewing machine to: select one piece of pattern data from the pattern data stored in the storage unit; extract a plurality of pieces of other pattern data from the pattern data stored in the storage unit randomly; generate images of a plurality of combined embroidery patterns as a combination of a plurality of embroidery patterns respectively corresponding to the plurality of pieces of other pattern data extracted by extracting and an embroidery pattern corresponding to the one piece of pattern data selected; and display the images of the combined embroidery patterns generated by the generating on a display.

According to the above structure, when a user intends to perform sewing of combined embroidery patterns, the user can select combined embroidery patterns while viewing images of a plurality of combined embroidery patterns displayed on the display. At this time, while the user's preference is reflected in the embroidery pattern of the one piece of pattern data, embroidery patterns to be combined with the embroidery pattern are randomly extracted. Therefore, combinations of various designs can be obtained while preventing the selection of the same type of design, and unexpected combinations of embroidery patterns that are not expected by the user can be obtained.

This summary is not intended to identify critical or essential features of the disclosure, but instead merely summarizes certain features and variations thereof. Other details and features will be described in the sections that follow.

BRIEF DESCRIPTION OF THE DRAWINGS

Aspects of the disclosure are illustrated by way of example, and not by limitation, in the accompanying figures in which like reference characters may indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments will be described with reference to the accompanying drawings.

(1) First Embodiment

Figure 1:
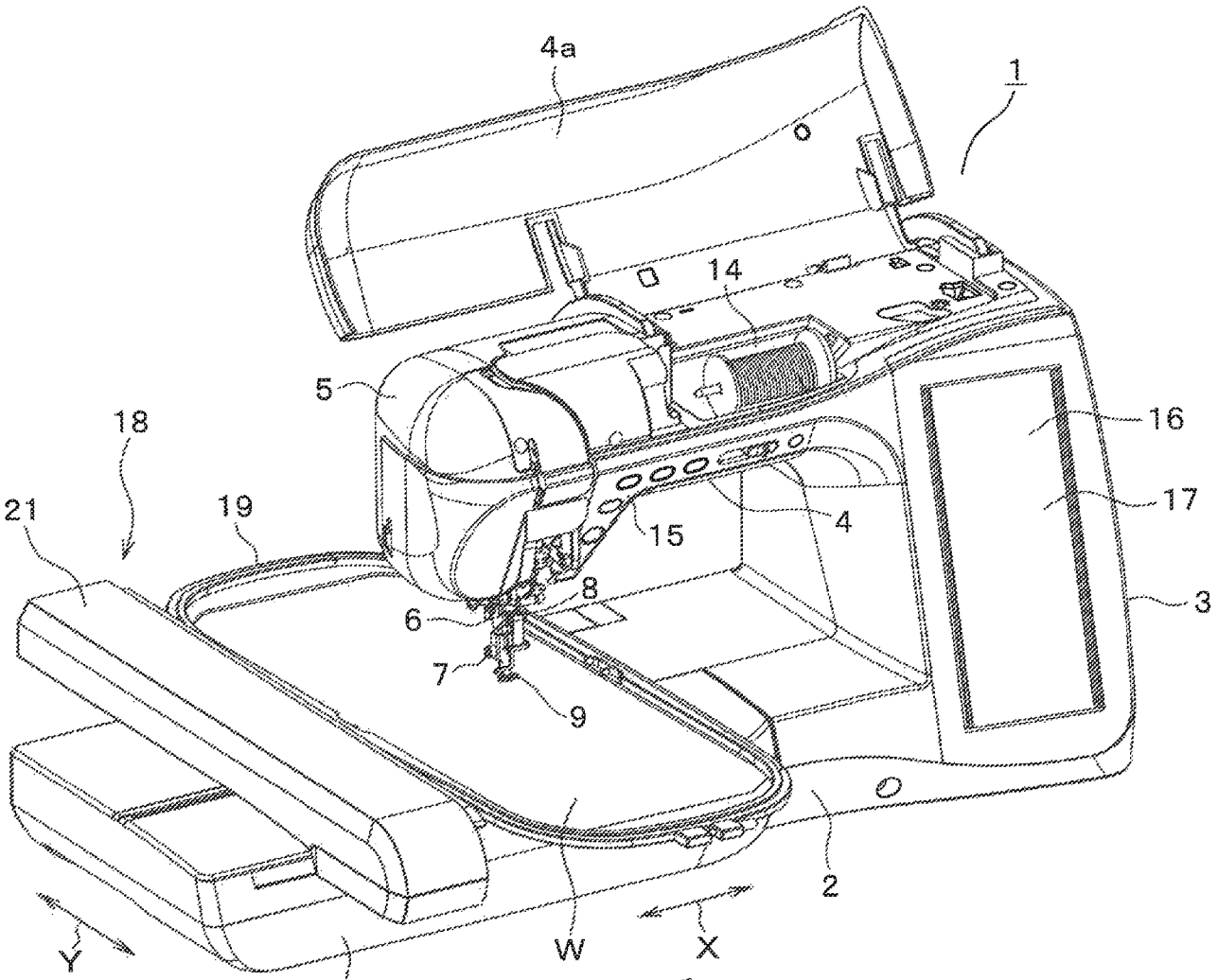
FIG. 1 is a perspective view illustrating a first embodiment of the present disclosure and illustrating an appearance structure of a sewing machine.

For example, a first embodiment to which an embroidery sewing machine is applied will be described with reference to FIGS. 1 to 10B. FIG. 1 illustrates a state in which the overall appearance of a sewing machine 1 according to this embodiment is viewed from the front side (user side). Note that the following description is made assuming that: a side where a user who operates the sewing machine 1 is located is referred to as a front side; a side opposite to the front side is referred to as a back side; the front-back direction is referred to as a Y-direction; a side where a pillar part 3 is located is referred to as a right side; a side opposite to the right side is referred to as a left side; and the right-left direction is referred to as an X-direction.

The sewing machine 1 according to this embodiment has a structure in which a sewing machine bed 2 extending in the X-direction in FIG. 1, the pillar part 3 extending upward from a right end of the sewing machine bed 2, and an arm part 4 extending leftward from an upper end of the pillar part 3 are integrally formed. A tip end of the arm part 4 corresponds to a sewing machine head part 5. The sewing machine head part 5 is provided with a needle bar 6 in such a way that the needle bar 6 can move up and down and swing in the X-direction. A needle 7 is mounted on a lower end of the needle bar 6. The sewing machine head part 5 is provided with a presser bar 8 that is located at the back side of the needle bar 6, and a presser foot 9 is attached to a lower end of the sewing machine head part 5.

Although not illustrated in detail, a main shaft that is rotationally driven by a sewing machine motor 10 (see FIG. 2) is provided in the arm part 4. A needle bar driving mechanism that causes the needle bar 6 to move up and down by driving the sewing machine motor 10 as well as the main shaft is provided in the sewing machine head part 5. Further, a needle bar swinging mechanism and the like that cause the needle bar 6 to swing in the X-direction by the needle swinging pulse motor 13 (see FIG. 2) serving as a drive source.

A cover 4*a* is mounted on an upper part of the arm part 4 so as to be openable and closable. A needle thread spool 14 is detachably set inside the cover 4*a* in the arm part 4 in order to supply a needle thread. A plurality of operation switches 15 is provided on a lower front of the arm part 4. These operation switches 15 include a start/stop key, a back stitch key, a needle up/down key, a thread cut key, a presser up/down key, and a speed adjusting knob, although a detailed description of these keys and knob will be omitted.

A large-sized vertically-long full-color liquid crystal display (LCD) 16 serving as a display is provided on the front side of the pillar part 3. A touch panel 17 is provided on the surface of the LCD 16. When the user operates the touch panel 17 by touching, the user can select a desired one of practical patterns, embroidery patterns, and the like or cause the sewing machine 1 to execute various functions for sewing. As described later, when the touch panel 17 generates combined embroidery patterns, the touch panel 17 serves as a selection unit for the user to select pattern data.

Although not illustrated in detail, a card slot 12 into which a memory card 11 (illustrated only in FIG. 2) is inserted is provided on the right side surface of the pillar part 3. The memory card 11 stores pattern data on various embroidery patters, such as characters, which are different from the pattern data originally stored in a ROM or an EEPROM of the sewing machine 1.

A needle plate (not illustrated) is provided on the upper surface of the sewing machine bed 2 so as to correspond to the needle bar 6. A shuttle mechanism, a feed dog driving mechanism, and the like are provided in the bed 2 so as to be located below the needle plate although none of them are illustrated. The shuttle mechanism accommodates a bobbin and serves to form stitches on a work cloth W in cooperation with the needle 7. The shuttle mechanism and the feed dog driving mechanism are driven by the sewing machine motor 10 serving as a drive source. Thus, the sewing machine motor 10, the needle bar driving mechanism, and the shuttle mechanism, among others, constitute a sewing mechanism for forming stitches on the work cloth.

Further, a well-known embroidery machine 18 is detachably mounted on a left part of the sewing machine bed 2. In a state where the embroidery machine 18 is mounted on the sewing machine bed 2, and is electrically connected to a control device 25, which described later, of the sewing machine 1 via a connector 24 (see FIG. 2) provided on the sewing machine bed 2. The embroidery machine 18 includes a transfer unit that causes an embroidery frame 19 that holds a work cloth W to be freely movable in two predetermined directions (in this case, in the X-direction and the Y-direction orthogonal to the X-direction) on the sewing machine bed 2.

Specifically, the embroidery machine 18 includes a movable body 21 that is long in the front-back direction on the upper surface of the main body part 20, which is mounted on the sewing machine bed 2, in such a way that the movable body 21 is movable in the X-direction. Although not illustrated in detail, a carriage is provided on the upper side surface of the movable body 21 in such a way the carriage is movable in the Y-direction. The embroidery frame 19 is detachably mounted on the carriage. The embroidery machine 18 causes the movable body 21 to be freely movable in the X-direction by the X-axis motor 22 (see FIG. 2) which is provided in the main body part 20. Further, the embroidery machine 18 is structured to cause the carriage, i.e., the embroidery frame 19 to freely move in the Y-direction by the Y-axis motor 23 (see FIG. 2) which is incorporated in the movable body 21.

With the above structure, in the sewing machine 1, the needle bar 6 and the like that constitute the sewing mechanism are driven while the embroidery frame 19 that holds a work cloth is freely moved in the X-direction and the Y-direction, thereby making it possible to execute an embroidery sewing operation on the work cloth W. Further, in this embodiment, the use of the embroidery machine 18 enables the sewing machine 1 to sew an embroidery pattern on the work cloth W on the basis of the pattern data. At this time, the pattern data is composed mainly of data indicating a needle location position for sewing an embroidery pattern (an amount of movement of the embroidery frame 19 for each stitch), i.e., data indicating amounts of movement in the X-direction and Y-direction of the work cloth W held by the embroidery frame 19.

Figure 2:
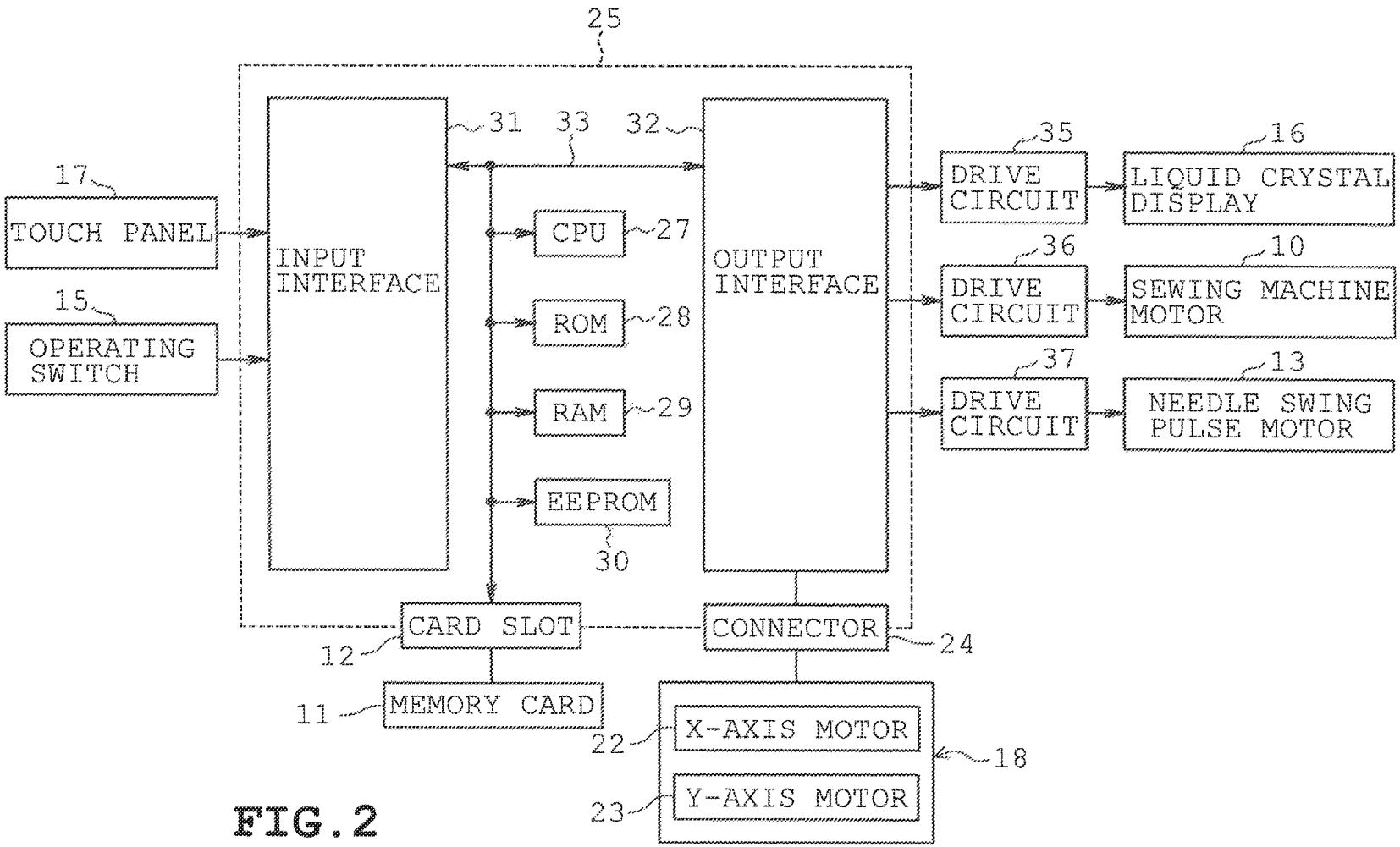
FIG. 2 is a block diagram schematically illustrating an electrical configuration of the sewing machine.

FIG. 2 schematically illustrates an electrical configuration of the sewing machine 1. In this case, the control device 25 that controls the entirety of the sewing machine 1 is composed mainly of a microcomputer and is configured by interconnecting a CPU 27, a ROM 28, a RAM 29, an EEPROM 30, the card slot 12, an input interface 31, and an output interface 32 via a bus 33. The ROM 28 stores programs such as a control program for controlling the sewing operation, and a pattern data processing program for generating combined embroidery patterns to be described later, and also stores various pieces of data necessary for the sewing operation, such as a plurality of pieces of pattern data. Note that the pattern data processing program may be loaded from a recording medium such as an optical disk or a USB memory, or may be downloaded from the outside via a network or the like.

The input interface 31 is connected to each of the touch panel 17 and the operation switch 15. Operation signals and the like for operating these components are input to the control device 25. The output interface 32 is connected to the LCD 16 via a drive circuit 35, and is also connected to the sewing machine motor 10 and the needle swinging pulse motor 13 via drive circuits 36 and 37, respectively. The control device 25 controls these components to execute the sewing operation. The output interface 32 is also connected to the connector 24, and the control device 25 also controls the embroidery machine 18. Thus, the control device 25 controls each mechanism of the sewing machine 1 to execute the sewing operation including sewing of an embroidery pattern.

Pattern data is data for sewing an embroidery pattern on the work cloth W and is a set of block data in which the embroidery pattern is divided into, for example, a plurality of blocks. Pieces of block data include needle location position data, sewing order data, thread color data, and the like. The pieces of pattern data also include display data for displaying an embroidery pattern on the LCD 16. In this embodiment, pieces of pattern data respectively corresponding to a large number of embroidery patterns are stored in the ROM 28, the EEPROM 30, and the memory card 11, which serve as a storage unit.

At this time, a plurality of pieces of pattern data is classified into any one of a plurality of types depending on the form of the embroidery pattern. Specifically, the pattern data is classified into "one-point", "kana (Japanese syllabary)", "alphabet", "frame", or "extended embroidery pattern". The extended embroidery pattern is an embroidery pattern based on the pattern data stored in the memory card 11. Among them, the "one-point" embroidery pattern is classified into a plurality of categories depending on the design. Specifically, the "one-point" embroidery pattern is classified into a plurality of categories such as animal, person, flower, vegetation, insect, butterfly, vehicle, food, small article, or various marks, and each piece of pattern data includes data indicating a category into which the pattern data is classified.

In this embodiment, each piece of pattern data includes data indicating a size (width and height dimensions) of an embroidery pattern as condition information. In this case, the embroidery pattern classified into the type of "frame" also includes data indicating the size (width and height dimensions) of the rectangular region of the frame. Further, in this embodiment, each piece of pattern data includes, as condition information, data indicating information about combinable categories, i.e., a correlation between categories of a plurality of combinable patterns. Specifically, correlations between combinable categories, such as a correlation between "flower" and "butterfly", a correlation between "flower" and "vegetation", and a correlation between "flower" and "girl", are stored in the ROM 28 or the EEPROM 30 as the condition information.

As will be described in detail later, in this embodiment, the control device 25 executes the above-mentioned pattern data processing program, thereby executing processing for generating combined embroidery patterns. Specifically, the user selects a menu for embroidery sewing on a menu screen by operating the touch panel 17, and edits the embroidery patterns, in particular, instructs selection of random generation of combined embroidery patterns. The control device 25 executes processing for generating combined embroidery patterns.

In the processing for generating combined embroidery patterns, the user first operates the touch panel 17 to, for example, select one piece of pattern data (referred to as main data) as main data in all pieces of pattern data, and designates the type (in this case, "one-point" or "frame") of pieces of other pattern data (referred to as sub-data) to be combined with the main data. Then, the control device 25 randomly extracts a plurality of pieces of other pattern data (sub-data) combinable with the main data. Next, the control device 25 generates images of a plurality of combined embroidery patterns obtained by combining a plurality of embroidery patterns respectively corresponding to a plurality of extracted sub-data with the embroidery pattern corresponding to the main data, and displays the generated images of the combined embroidery patterns on the LCD 16.

Figure 10A:
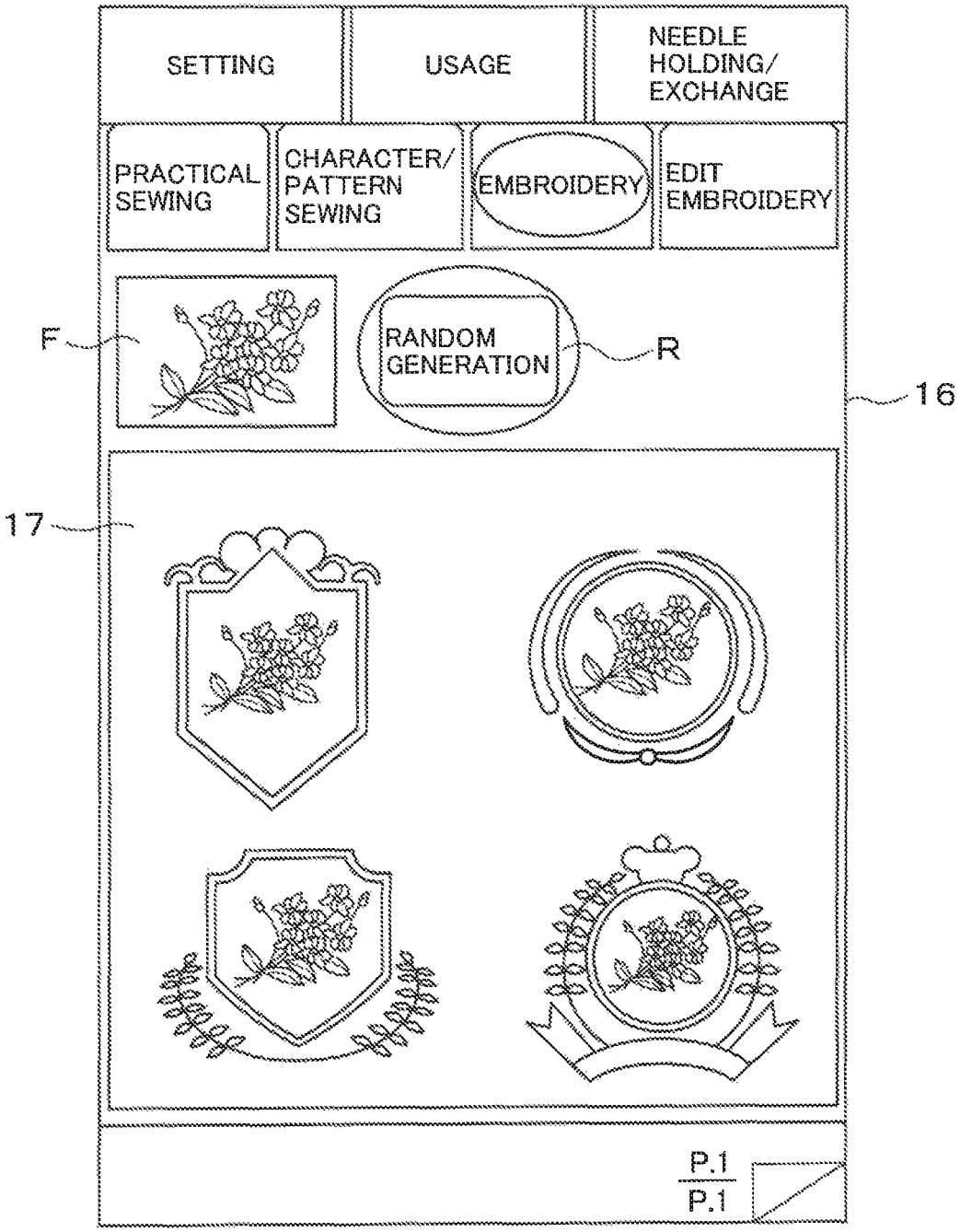
FIG. 10A is a diagram illustrating an example of thumbnail images displayed on two screens for combined embroidery patterns (No. 1).

At this time, as illustrated in FIG. 10A, the images of a plurality of (e.g., four) combined embroidery patterns are displayed as thumbnail images on one screen of the LCD 16. Accordingly, the control device 25 functions as an extraction unit, an image generation unit, and a display unit. The user selects a desired combined embroidery pattern from the displayed images of the combined embroidery patterns, thereby allowing the sewing machine 1 to perform sewing of the combined embroidery pattern and the EEPROM 30 to store the pattern data.

In this embodiment, the control device 25 randomly extracts sub-data, the sub-data determined to be combined with the main data is extracted in accordance with the condition information (data indicating the size of the embroidery pattern and data indicating combinable categories) included in each piece of pattern data of the main data and sub-data. This prevents the main data and sub-data from being inappropriately combined in terms of size. Alternatively, the main data and the sub-data whose categories can be combined are combined.

In particular, in this embodiment, in the case of a combination of "one-point" as the type of the main data and "frame" as the type of the sub-data, when there is a possibility that the sizes of the embroidery patters are unbalanced, the control device 25 enlarges or reduces the size of one of the embroidery patterns on the basis of the data indicating the size of the pattern. Thus, the control device 25 also serves as a size change unit. However, there is a maximum size (corresponding to the size of the embroidery frame 19) with which sewing is enabled by the sewing machine 1. Accordingly, when the size of the combined embroidery pattern exceeds the maximum size, the combined embroidery pattern is excluded from the extraction target. Alternatively, the entire size is reduced so as to fall within the maximum size. Data of the maximum size with which sewing of each embroidery frame 19 is enabled is stored in, for example, the ROM 28.

Next, the operation of the sewing machine 1 of this embodiment including the above-described structure will be described with reference to FIGS. 3 to 10. The flowcharts of FIGS. 3 to 6 illustrate a processing procedure (routine) for generating combined embroidery patterns executed by the control device 25 using the above-mentioned pattern data processing program.

Figure 3:
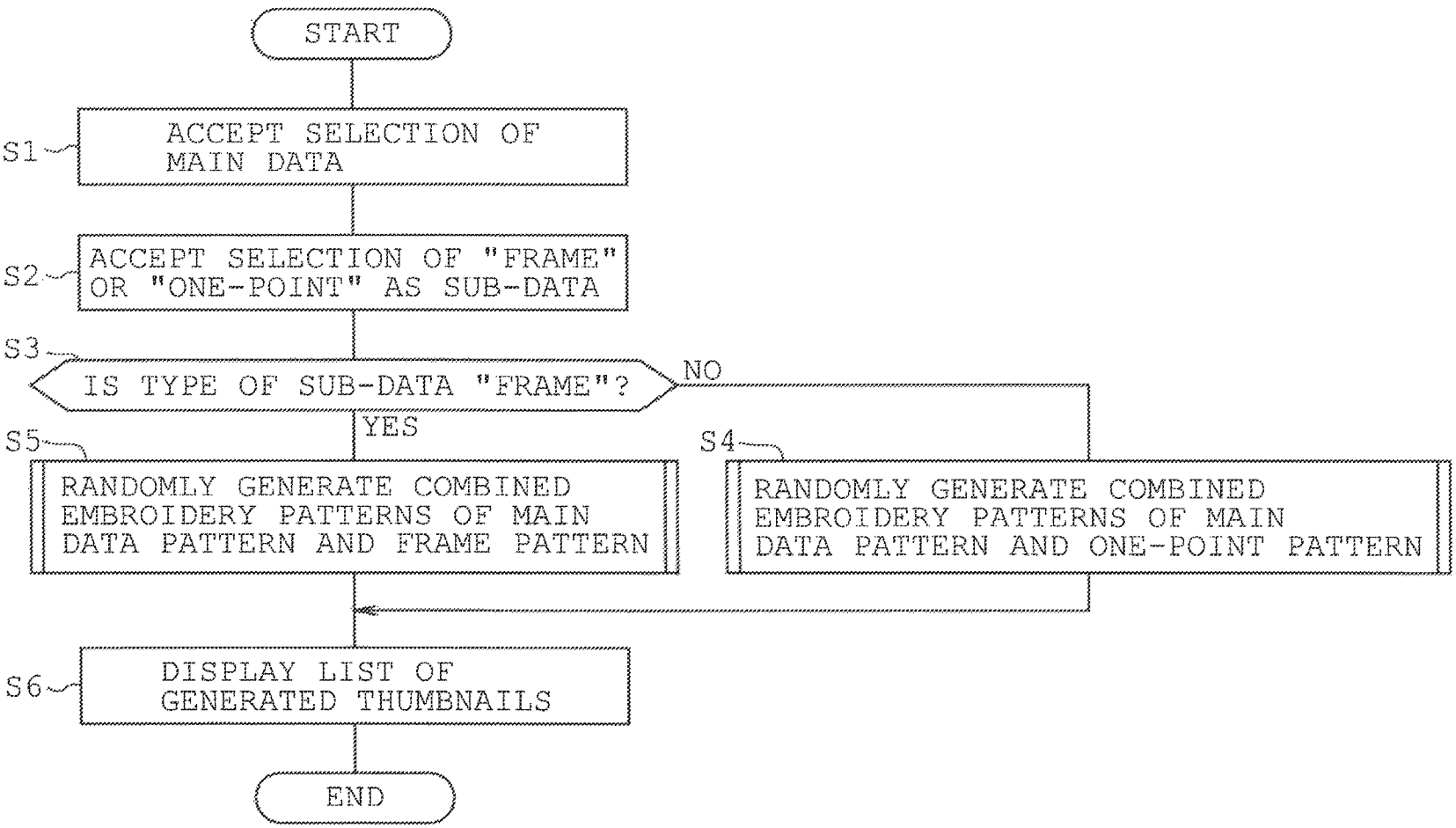
FIG. 3 is a flowchart illustrating an overall procedure of processing for generating combined embroidery patterns.
Figure 4:
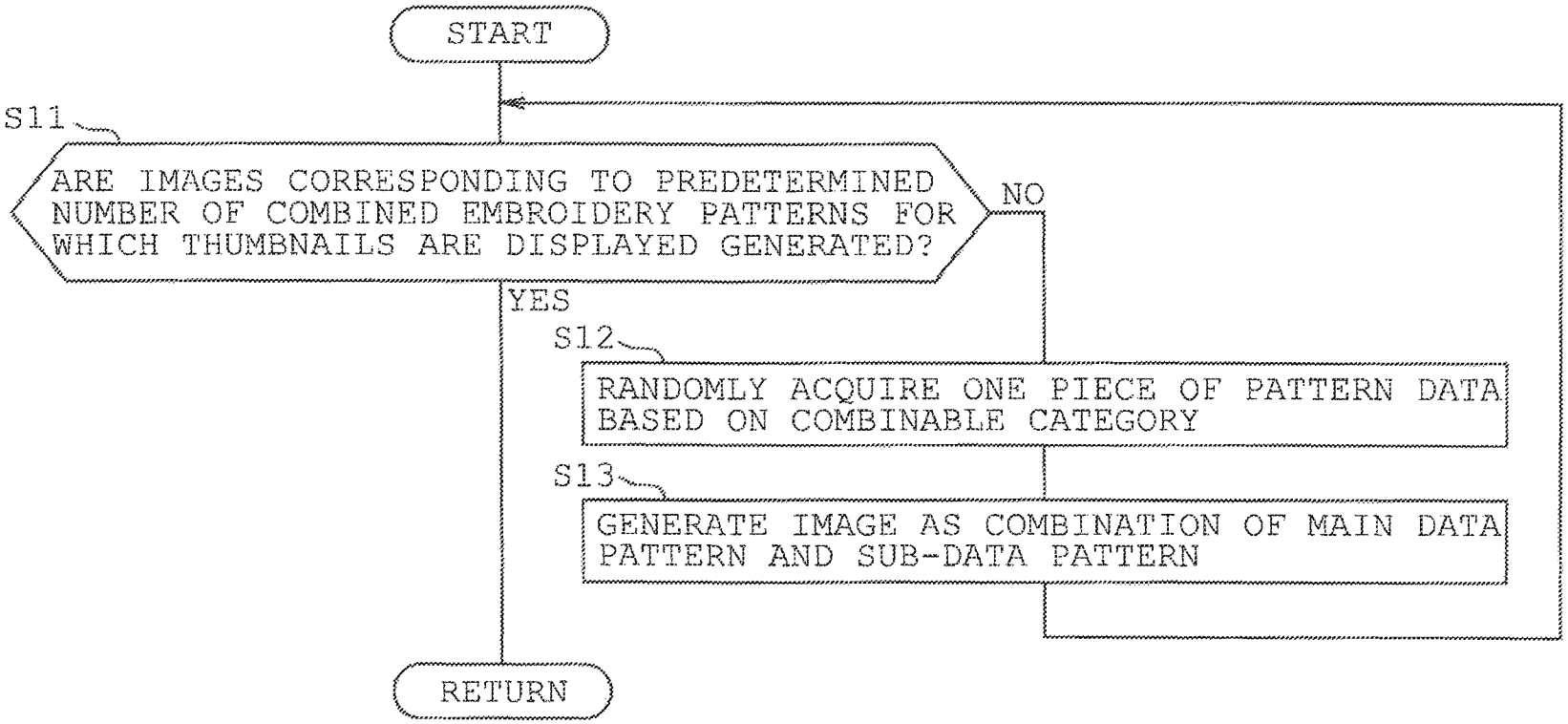
FIG. 4 is a flowchart illustrating a detailed processing procedure of step S4 in FIG. 3.
Figure 8:
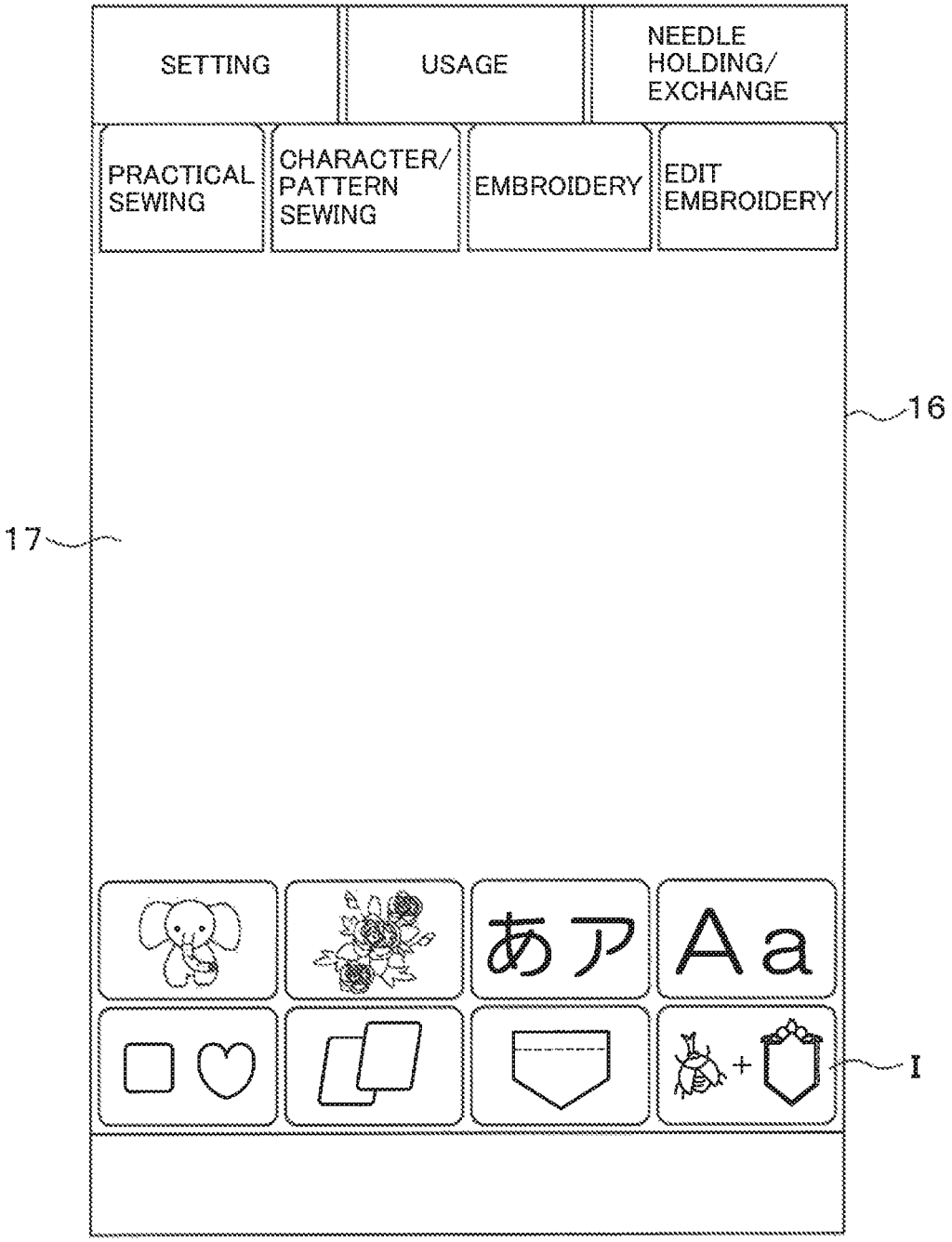
FIG. 8 is a diagram illustrating an example of an embroidery pattern selection screen on a liquid crystal display.
Figure 9:
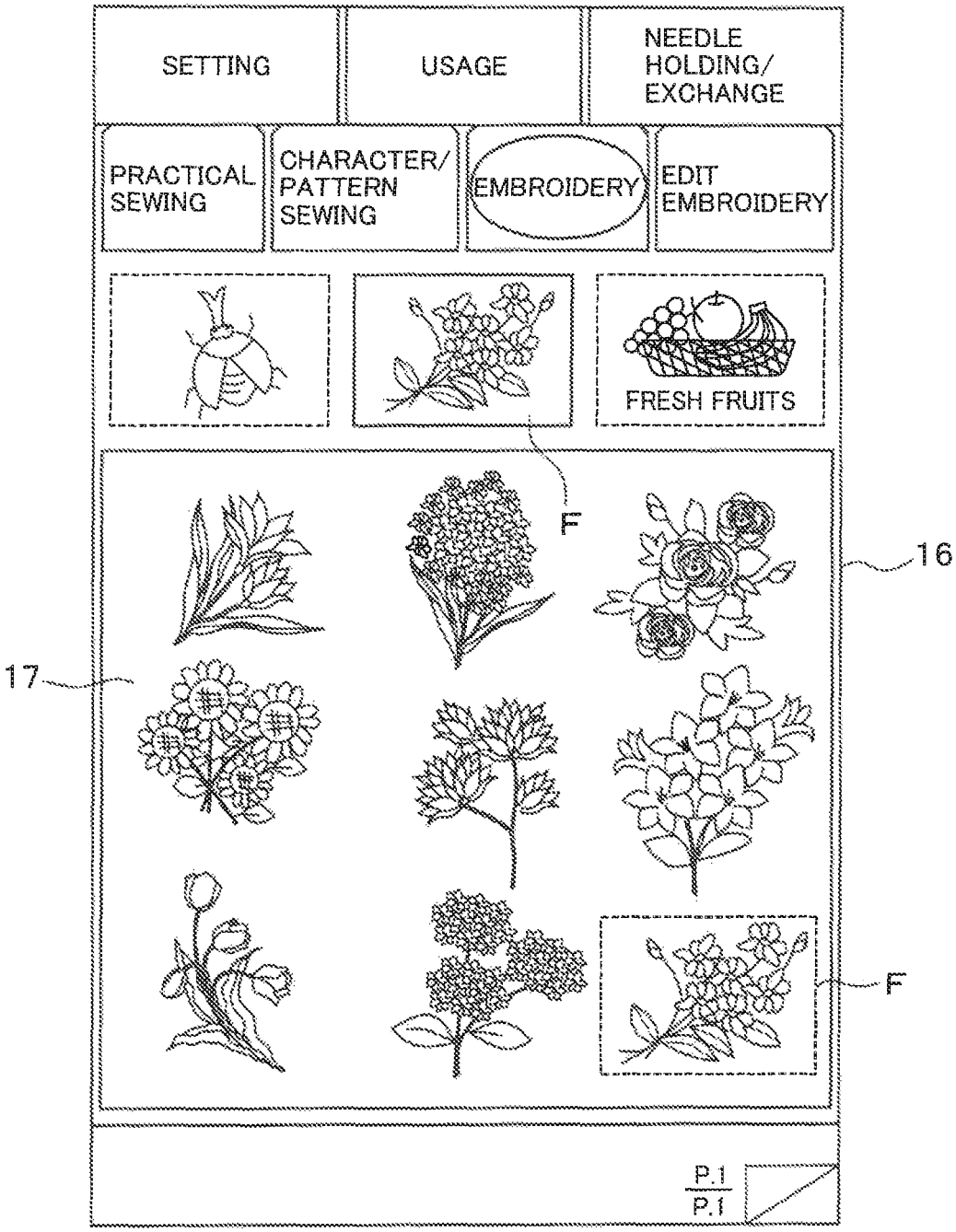
FIG. 9 is a diagram illustrating an example of a one-point pattern selection screen.

When the user intends to randomly generate combined embroidery patterns, the user operates an ion I for combined embroidery patterns by touching on the touch panel 17 on the embroidery pattern selection screen of the LCD 16 as illustrated in FIG. 8. As a result, the processing for generating combined embroidery patterns is started. As illustrated in FIG. 3, first in step S1, the selection of main data by the user is accepted. The selection of the main data is performed through a touching operation of a desired embroidery pattern on the one-point pattern selection screen of the LCD 16 as illustrated in, for example, FIG. 9 (selection routine). FIG. 9 illustrates a state in which the one-point pattern of "flower F" which is classified into the category of "flower" is selected, for example, as the main data.

Referring to FIG. 3 again, in step S2, the selection of "one-point" or "frame" is accepted as the type of the embroidery pattern (sub-data pattern) to be combined with the pattern of the main data. In step S3, it is determined whether or not the selected type of sub-data is "frame", and when the type of sub-data is not "frame" but "one-point" (No in step S3), the process proceeds to step S4. In this step S4, processing for randomly generating combined embroidery patterns of the pattern of the main data (main data pattern) and the one-point pattern is performed. Details of the processing of step S4 will be described with reference to FIG. 4.

Specifically, in step S11, it is determined whether a predetermined number of images of combined embroidery patterns to be displayed as thumbnail images are generated. When the predetermined number of combined embroidery patterns are not generated yet (No in step S11), in step S12, one piece of pattern data (sub-data) is randomly extracted from the pattern data of the one-point pattern on the basis of the condition information combinable with the main data, i.e., category information that can be combined (extraction routine). In this case, since the main data belongs to the category of "flower", sub-data is randomly extracted from the categories of the "butterfly", "vegetation", and "girl" as the pattern data that can be combined.

In the subsequent step S13, the images of the combined embroidery patterns of the pattern of the main data and the pattern of the sub-data are generated (image generation routine). When the image generation processing is completed, the process returns to step S11, it is determined whether or not the predetermined number of images of combined embroidery patterns are generated, and the processing of steps S12 and S13 is repeated until the predetermined number of images are generated. Then, when the predetermined number of image of combined embroidery patterns obtained by combining the pattern of the main data and the pattern of the sub-data are generated (Yes in step S11), this sub-routine processing is completed and the process returns to FIG. 3.

Referring again to FIG. 3, in step S3, when it is determined that the type of the sub-data selected in step S2 is "frame" (Yes in step S3), the process proceeds to step S5. In this step S5, processing for randomly generating combined embroidery patterns of the pattern of the main data (main data pattern) and the frame pattern is performed. Details of the processing of this step S5 will be described with reference to FIG. 5. Specifically, in step S21, it is determined whether or not the predetermined number of images of combined embroidery patterns to be displayed as thumbnail images are generated. When the predetermined number of combined embroidery patterns are not generate yet (No in step S21), the process proceeds to step S22. In this step S22, one piece of frame pattern to be combined with the pattern of the main data is randomly extracted from the pattern data of the type of "frame" (extraction routine).

Figure 6:
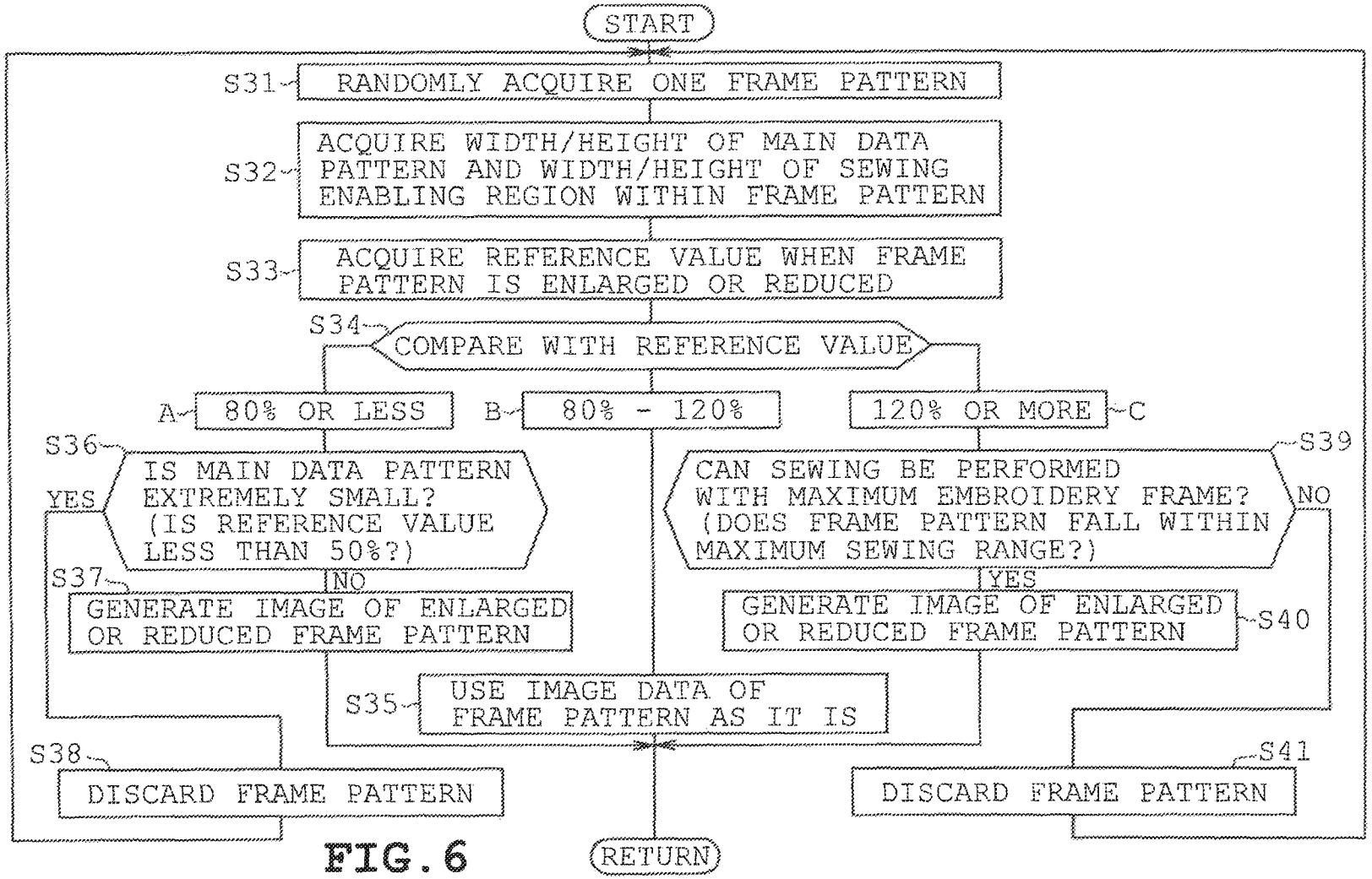
FIG. 6 is a flowchart illustrating a detailed processing procedure of step S22 in FIG. 5.

Details of the processing (step S22) for randomly extracting the frame pattern are illustrated in FIG. 6. Specifically, in step S31, one piece of pattern data is randomly acquired from a plurality of pieces of pattern data of "frame". In the next step S32, data indicating the size (width and height dimensions) of the embroidery pattern of the main data and data indicating the size (width and height dimensions) of the rectangular region of the frame of the pattern data (sub-data) of the extracted frame. In step S33, a reference value (a parameter such as an occupancy) for determining the enlargement or reduction of the frame pattern is obtained.

Figure 7A:
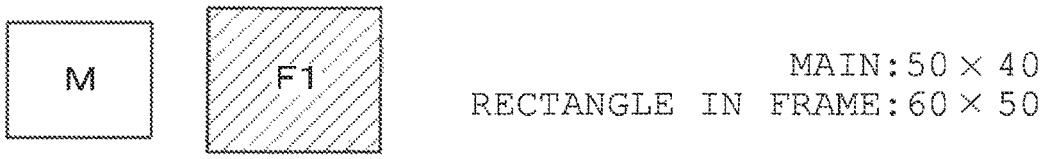
FIG. 7A is a diagram illustrating a size of main data and a pattern of an inside size of a frame (No. 1).

A reference value S for determining the enlargement or reduction of frame patterns will now be described. FIGS. 7A to 7E illustrate examples of five sizes of rectangular regions F1, F2, F3, F2', and F3' in the frame patter of sub-data with respect to the size of the pattern of main data M. For example, as the size of the pattern of the main data M, a width dimension W1 is 50 mm and a height dimension H1 is 40 mm. Referring to FIG. 7A, a width dimension W2 of the rectangular region F1 in the frame pattern is 60 mm and a height dimension H2 thereof is 50 mm. At this time, the ratio (W1/W2: unit %) of the width dimension based on the pattern of the main data M is 83.3%. The reference value S (unit %) is a value obtained by multiplying the reciprocal of the ratio of the width dimensions by the ratio (H1/H2) of the height dimensions. In this case, the reference value S is 96.0%.

Referring to FIG. 6, in step S34, it is determined which one of three ranges: (A) 80% or less; (B) a range from 80% to 120%; and (C) 120% or higher the reference value S falls within. When the reference value S is in (B) the range from 80% to 120%, in step S35, the frame pattern is extracted so that the image of the frame pattern is used as it is, and the process returns to FIG. 5. On the other hand, when the reference value S is 80% or less (A), in step S36, it is determined whether the pattern of the main data is extremely smaller than the frame pattern. Specifically, it is determined whether the reference value S is less than 50%.

Figure 5:
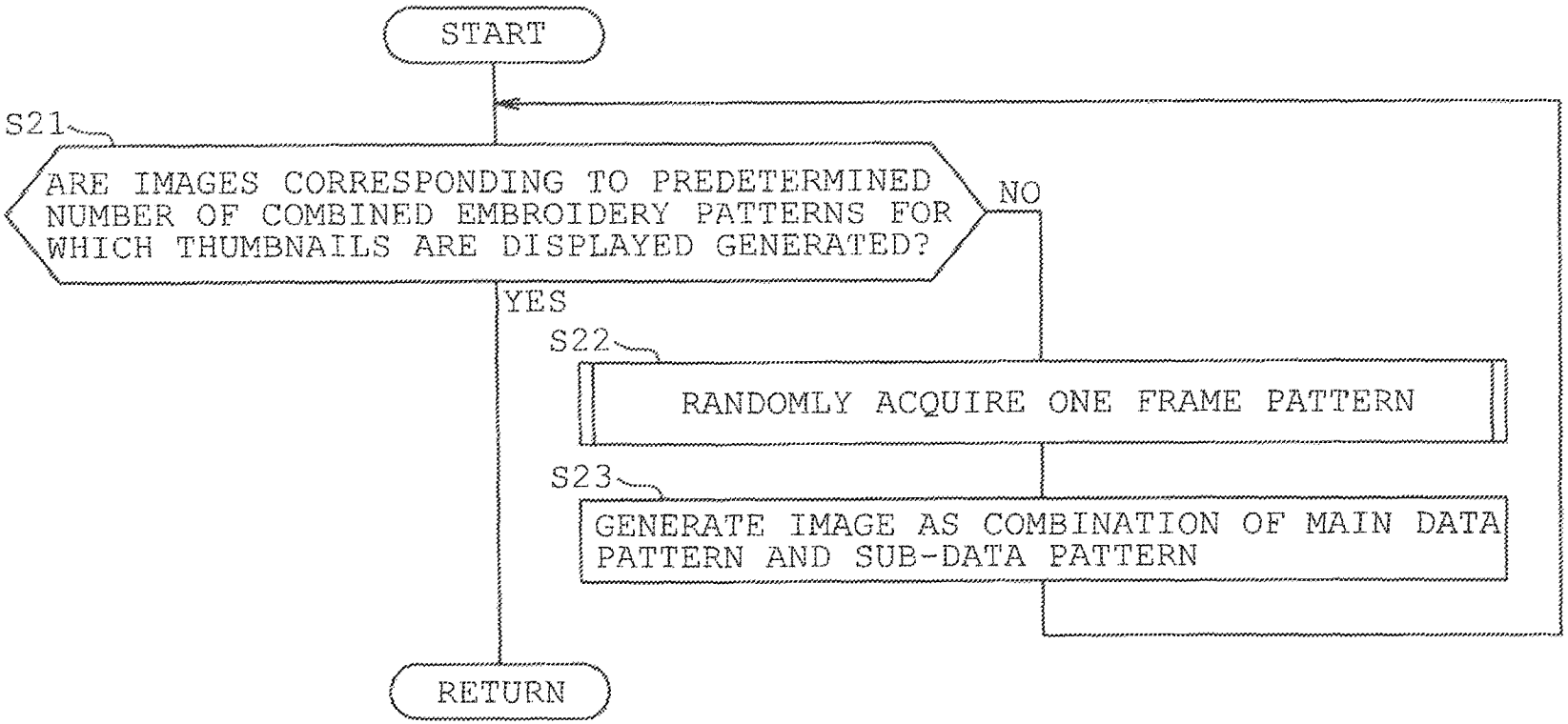
FIG. 5 is a flowchart illustrating a detailed processing procedure of step S5 in FIG. 3.

When the reference value S is equal to or greater than 50% (No in step S36), in step S37, the image of the frame pattern is generated by enlarging or reducing the size of the frame pattern in accordance with the reference value S (size change routine), and the process returns to FIG. 5. On the other hand, when the reference value S is less than 50% (Yes in step S36), in step S38, it is determined that the pattern of the main data is extremely smaller than the frame pattern, the frame pattern is excluded from the extraction target and cannot be used. In this case, the process proceeds back to step S31 and the random extraction of frame patterns is performed.

Figure 7B:
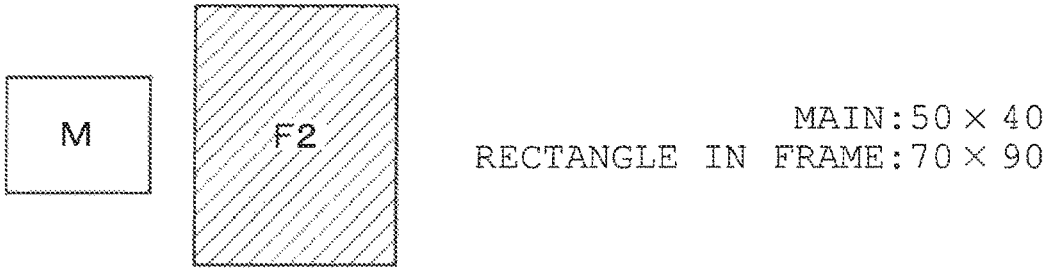
FIG. 7B is a diagram illustrating a size of main data and a pattern of an inside size of a frame (No. 2).
Figure 7C:
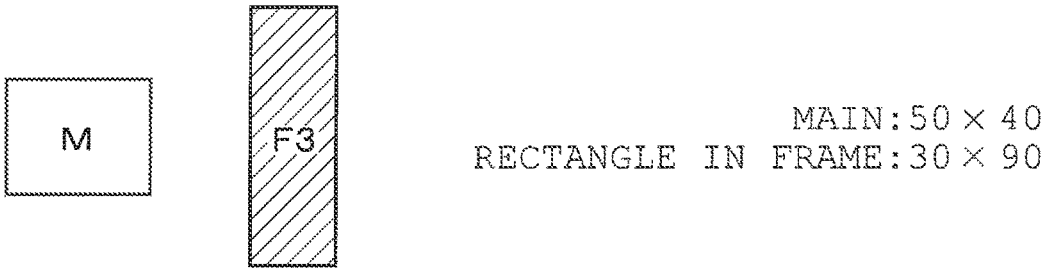
FIG. 7C is a diagram illustrating a size of main data and a pattern of an inside size of a frame (No. 3).

Referring to FIG. 7B, the width dimension W2 of the rectangular region F2 of the frame pattern is 70 mm and the height dimension H2 thereof is 90 mm. In this case, the ratio (W1/W2) of the width dimension is 71.4% and the reference value S is 62.2%. Accordingly, in this example, in step S37, the size of the frame pattern is reduced according to the reference value S. Referring to FIG. 7C, the width dimension W2 of the rectangular region F3 of the frame pattern is 30 mm and the height dimension H2 thereof is 90 mm. In this case, the ratio (W1/W2) of the width dimension is 166.6% and the reference value S is 26.3%. Accordingly, in this example, in step S38, the frame pattern is excluded from the extraction target.

Referring again to FIG. 6, when the reference value S is equal to or greater than 120% (C), in step S39, it is determined whether the size of the combined embroidery pattern exceeds the maximum size with which sewing is enabled (maximum range in which the embroidery frame 19 can be sewn). When the size of the combined embroidery pattern falls in the maximum size with which sewing is enabled (Yes in step S39), in step S40, the image of the frame pattern is generated by enlarging or reducing the size of the frame pattern in accordance with the reference value S, and the process returns to FIG. 5. When the size of the combined embroidery pattern exceeds the maximum size with which sewing is enabled (No in step S39), in step S41, the frame pattern is excluded from the extraction target, and the processing from step S31 is repeated.

Figure 7D:
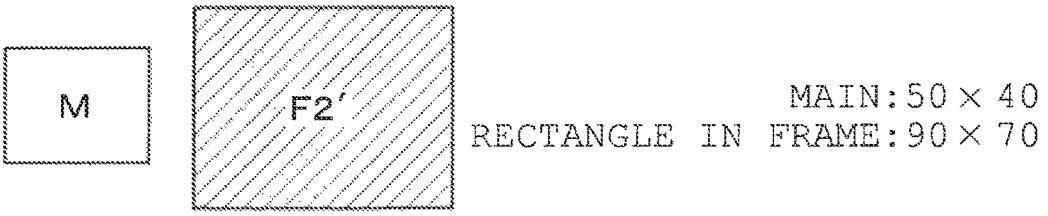
FIG. 7D is a diagram illustrating a size of main data and a pattern of an inside size of a frame (No. 4).
Figure 7E:
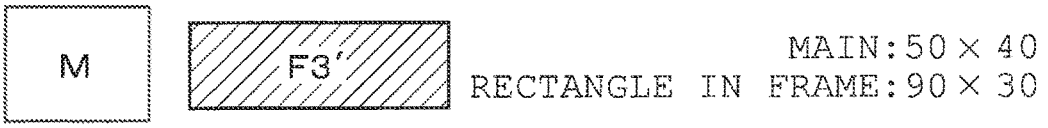
FIG. 7E is a diagram illustrating a size of main data and a pattern of an inside size of a frame (No. 5).

The frame patterns illustrated in FIGS. 7B and 7C are pattern data that can be used also when the patterns are rotated by 90 degrees. FIG. 7D illustrates the frame pattern illustrated in FIG. 7B being rotated by 90 degrees; the width dimension W2 of the rectangular region F2' of the frame pattern is 90 mm; and the height dimension H2 is 70 mm. In this case, the ratio (H1/H2) of the height dimensions based on the pattern of the main data M is 57.1%. Thus, when the ratio (H1/H2) of the height dimensions is extremely small, the use of the pattern data of the frame pattern may be prohibited. FIG. 7E illustrates the frame pattern illustrated in FIG. 7C being rotated by 90 degrees; the width dimension W2 of the rectangular region F3' of the frame pattern is 90 mm; and the height dimension H2 is 30 mm. In this case, the ratio (H1/H2) of the height dimensions is 133.3%, while the reference value S obtained by multiplying the reciprocal of the ratio of the height dimensions by the ratio (W1/W2) of the width dimensions is 41.6%. Since the reference value S is less than 50%, the frame cannot be used.

Referring again to FIG. 5, when the processing for randomly extracting one piece of frame pattern (step S22) is completed, in step S23, the images of combined embroidery patterns obtained by combining the pattern of the main data and the pattern of the sub-data are generated (image generation routine). When this image generation processing is completed, the process returns to step S21 and it is determined whether or not the predetermined number of images of combined embroidery patterns are prepared, the processing of steps S22 and S23 is repeated until the predetermined number of images are generated. Thus, when the predetermined number of images of combined embroidery patterns obtained by combining the pattern of the main data and the pattern of the sub-data are generated (Yes in step S12), this sub-routine processing is completed and the process returns to FIG. 3.

Figure 10B:
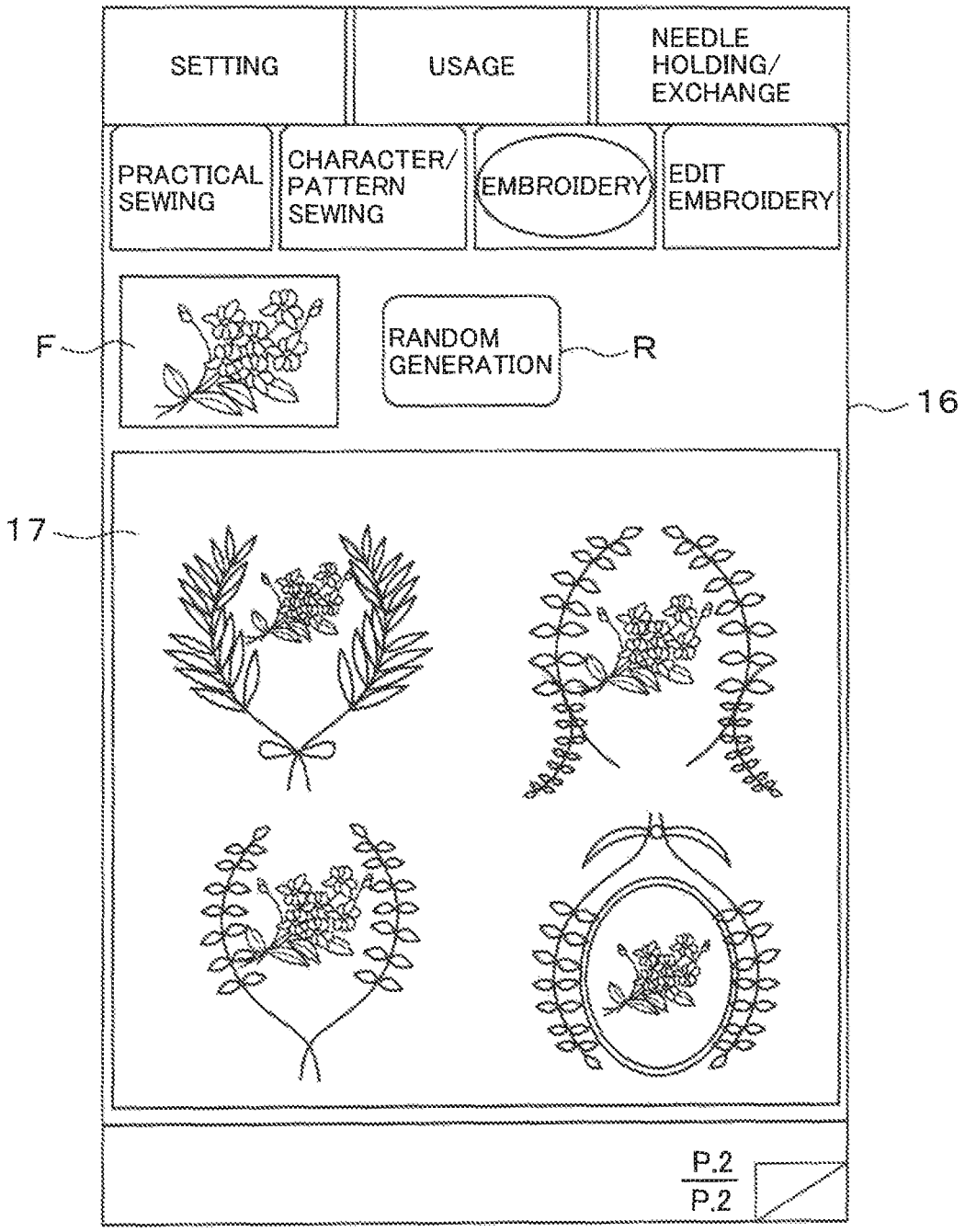
FIG. 10B is a diagram illustrating an example of thumbnail images displayed on two screens for combined embroidery patterns (No. 2).

In FIG. 3, the processing for generating combined embroidery patterns in step S4 or step S5 is completed, and in the next step S6, a list of a plurality of images of combined embroidery patterns is displayed as thumbnail images on the screen of the LCD 16 (display routine). FIG. 10A illustrates an example in which a plurality of combined embroidery patterns obtained by combining the embroidery pattern of "flower" as the main data and the embroidery of "frame" as the randomly extracted sub-data are displayed as thumbnail images. In the state in which the thumbnail images are displayed as illustrated in FIG. 10A, when a random generation button R is depressed, the processing is executed again from the processing of step S5 of FIG. 3. As a result, as illustrated in FIG. 10B, thumbnail images of a plurality of combined embroidery patterns obtained by combining the embroidery pattern of "flower" as the main data and the embroidery pattern of "frame" as the sub-data which is newly, randomly extracted. Previously created four thumbnail images illustrated in FIG. 10A and four newly created thumbnail images illustrated in FIG. 10B are displayed on, for example, two pages.

Although not illustrated in FIG. 3, the user selects a desired combined embroidery pattern by the touch operation on the touch panel 17, while viewing the screen of the LCD 16 on which the combined embroidery patterns are displayed as thumbnail images, thereby allowing the sewing machine 1 to execute the sewing operation. In this case, processing for editing pattern data is performed, as needed, for example, when pattern data is enlarged or reduced. The pattern data of the generated combined embroidery patterns may be stored in, for example, the EEPROM 30 or an external storage medium.

Thus, according to this embodiment, the sewing machine 1 includes the ROM 28 and the like which store a plurality of pieces of pattern data respectively corresponding to a plurality of embroidery patterns, and is capable of sewing an embroidery pattern on the work cloth W on the basis of the pattern data. In the sewing machine 1, the pattern data processing program is executed to thereby make it possible to execute processing for generating combined embroidery patterns. At this time, while the user's preference is reflected in the embroidery pattern of one piece of pattern data as the main data, embroidery patterns, or sub-data, to be combined with the main data are randomly extracted. Therefore, combinations of various designs can be obtained while preventing the selection of the same type of design, and unexpected combinations of embroidery patterns that are not expected by the user can be obtained.

At this time, a large number of pieces of pattern data are classified into any one of types (one-point, kana (Japanese syllabary), frame, etc.), and the plurality of sub-data is randomly extracted from the pattern data classified into types other than the type into which the main data is classified. Therefore, combinations of different types of embroidery patterns can be obtained. In many cases, it is not preferable to select a combination of the same type of embroidery patterns, and thus the selection of such a combination of patterns can be excluded.

In particular, in this embodiment, the condition information for specifying the embroidery patterns combinable with a plurality of pieces of pattern data is provided so as to be associated with the main data. Accordingly, combinations of the pattern of the main data and the pattern of sub-data adaptable to the condition information can be obtained, and the acquisition of inappropriate combinations can be excluded in advance. More specifically, information for specifying the size of each embroidery pattern of pattern data is use as the condition information, which makes it possible to prevent the acquisition of inappropriate combinations for the size of the pattern of the main data and the pattern of the sub-data and obtain an appropriate combination in terms of size.

In this case, only the embroidery patterns having a size that is equal to or greater than a predetermined ratio with respect to the size of the combinable region are extracted, thereby making it possible to excluding combinations of patterns with unbalanced sizes and obtain appropriate combinations. In addition, since the size of the embroidery pattern of sub-data can be enlarged or reduced, even when the sizes of the patterns become unbalanced in the standard size, favorable combined embroidery patterns in which the sizes of patterns are balanced can be obtained by enlarging or reducing the size of the sub-data.

Although the sewing machine 1 has the maximum size with which sewing is enabled, in this embodiment, when the size of the enlarged combined embroidery pattern exceeds the maximum size, the sub-data is excluded from the extraction target. Thus, the extraction of inappropriate combinations can be prevented and combined embroidery patterns that can be sewn can be provided.

In particular, in this embodiment, when the category information classified depending on the design of the embroidery pattern is stored as the condition information associated with the pattern data and the embroidery patterns are combined, sub-data can also be extracted based on the correlation between the categories of the embroidery combinable patterns. Consequently, an appropriate combination of categories of embroidery patterns, such as a combination of "flower" and "butterfly", can be obtained, so that a wide variety of combined embroidery patterns can be obtained.

Further, in this embodiment, a list of a plurality of combined embroidery patterns is displayed (displayed as thumbnail images) on one screen of the LCD 16, which allows the user to view the plurality of combined embroidery patterns on one screen and easily compare and review the combined embroidery patterns. Furthermore, the user's operation, such as page switching or selection, is facilitated as compared to a case where one or a small number of combined embroidery patterns are displayed on one screen.

(2) Other Embodiments

Figure 11:
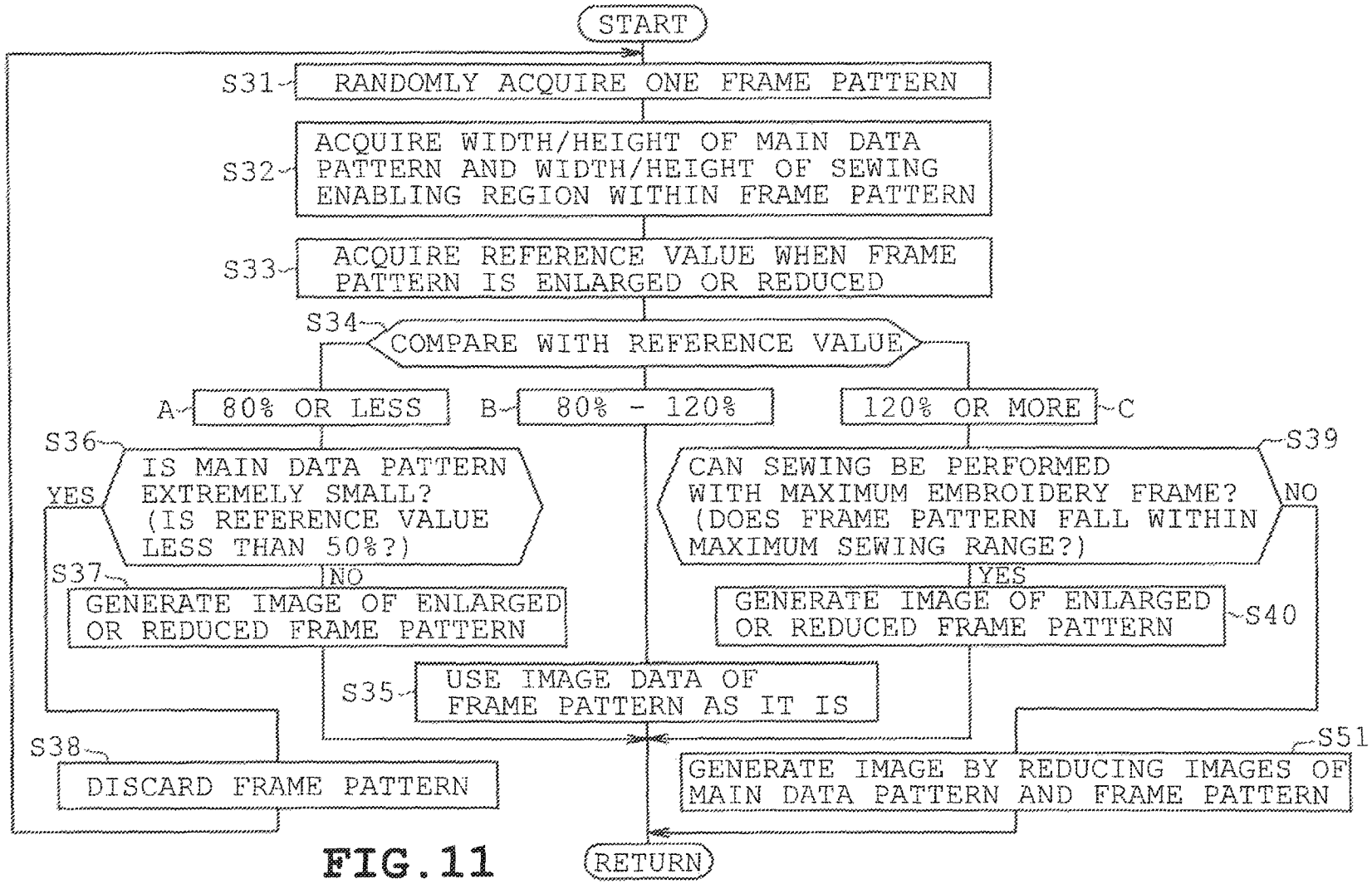
FIG. 11 is a diagram corresponding to FIG. 6 and illustrating a second embodiment.

FIG. 11 illustrates a second embodiment of the present disclosure and illustrates a detailed procedure (sub-routine) of detailed processing (processing for randomly extracting a frame pattern) in step S22 of FIG. 5. This second embodiment differs from the first embodiment in the following points. That is, when the reference value S is equal to or greater than 120% (C in step S34), in step S39, it is determined whether or not the size of the combined embroidery pattern falls within the maximum size with which sewing is enabled. When the size of the combined embroidery pattern exceeds the maximum size (No in step S39), the processing of step S51 is executed instead of excluding the frame pattern from the extraction target (step S41).

In this step S51, the size of the combined embroidery pattern is reduced so that the pattern of the main data and the frame pattern of the sub-data fall within the maximum size with which sewing is enabled, and the process returns to FIG. 5. Accordingly, even when it is determined that the size of the combined embroidery pattern exceeds the maximum size with which sewing is enabled by the sewing machine 1, the combination can be used by reducing the entire size of the combination, without discarding the combination. Thus, the combined embroidery pattern that can be sewn by reducing the size of the combined embroidery pattern can be provided.

Figure 12A:
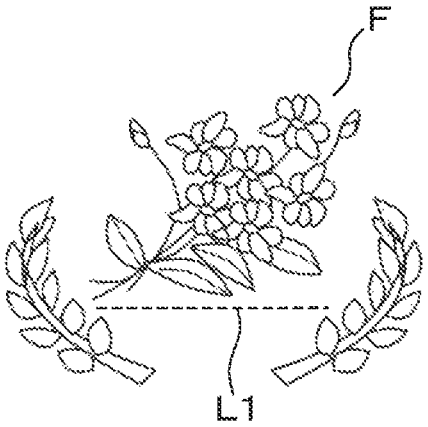
FIG. 12A is a diagram illustrating a third embodiment and used for explaining a method for combining frame patterns that are opened upward.
Figure 12B:
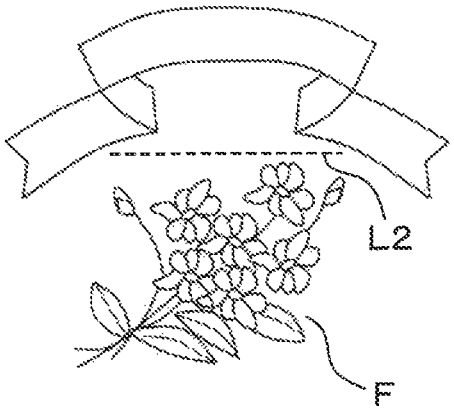
FIG. 12B is a diagram illustrating the third embodiment and used for explaining a method for combining frame patterns that are opened downward.

FIG. 12 illustrates a third embodiment of the present disclosure and illustrates a method for arranging combined embroidery patterns when, for example, the one-point pattern of "flower F" as the main data and the frame pattern having a form that is opened upward or downward as the sub-data. Specifically, as illustrated in FIG. 12A, when the frame pattern has a form that is opened upward, a lower limit line L1 is set for the frame pattern. On the other hand, when the rectangular region is set in the pattern of the main data and the lower side thereof is superimposed on the lower limit line L1, thereby making it possible to combine two embroidery patterns. At this time, the center point of the lower side of the pattern of the main data is set so as to match the center point of the lower limit line L1. As illustrated in FIG. 12B, when the frame pattern has a form that is opened downward, an upper limit line L2 is set for the frame pattern. Also in this case, the center point of the upper side of the pattern of the main data is set so as to match the center point of the upper limit line L2, and the upper side of the rectangular region of the pattern of the main data is superimposed on the upper limit line L2, thereby making it possible to combine two embroidery patterns.

Figure 13A:
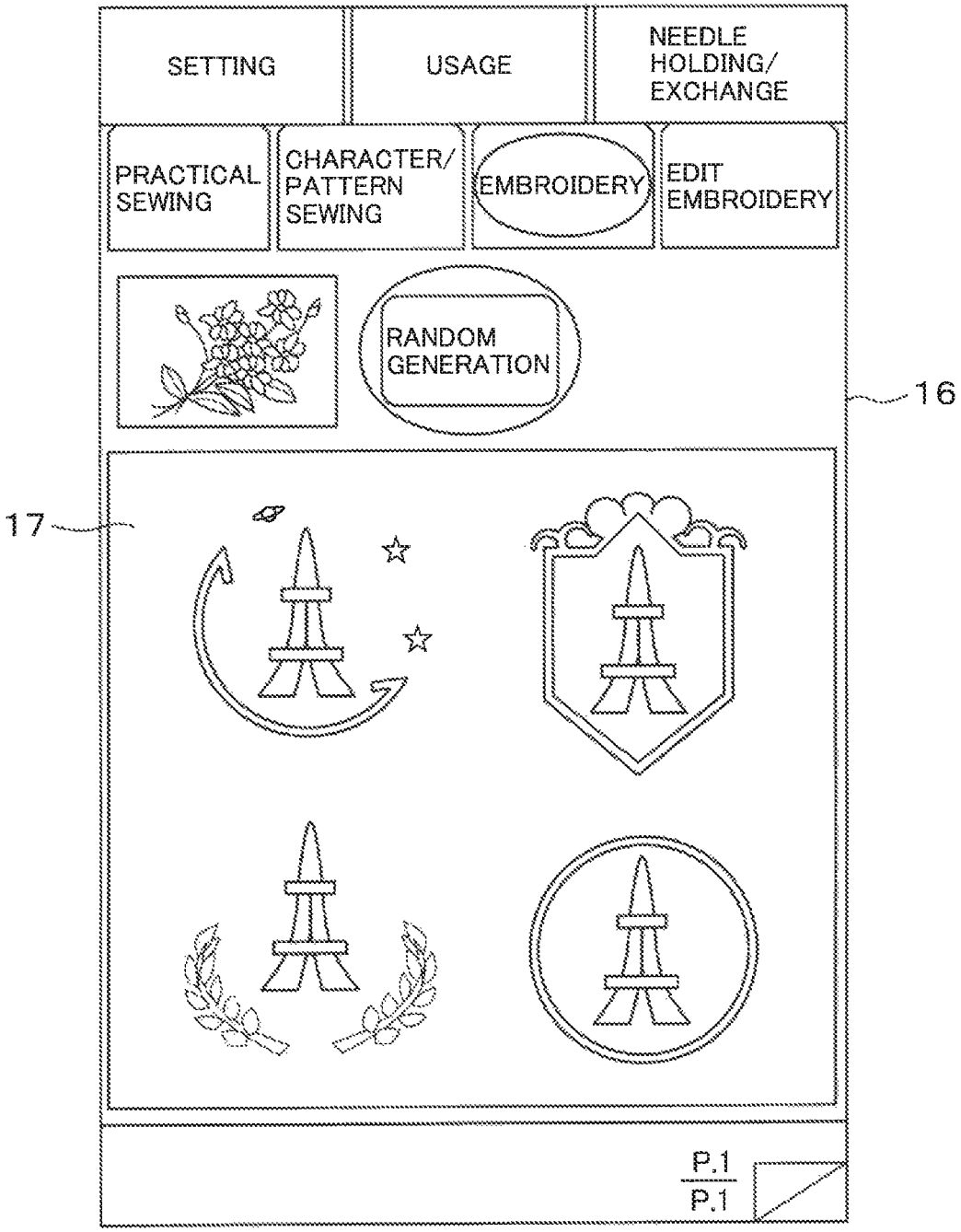
FIG. 13A is a diagram illustrating a fourth embodiment and illustrating an example of a thumbnail display of combined embroidery patterns.

FIG. 13 illustrates a fourth embodiment of the present disclosure. In this embodiment, a plurality of combined embroidery patterns is displayed as thumbnail images, and when any one of the combined embroidery patterns is selected by the user, a random combination of colors for the combined embroidery pattern is displayed as thumbnail images. In this case, as illustrated in FIG. 13A, for example, a plurality of combined embroidery patterns obtained by randomly combining the one-point pattern of "broadcast tower" as the main data and a plurality of frame patterns as the sub-data is displayed as thumbnail images on the LCD 16.

Figure 13B:
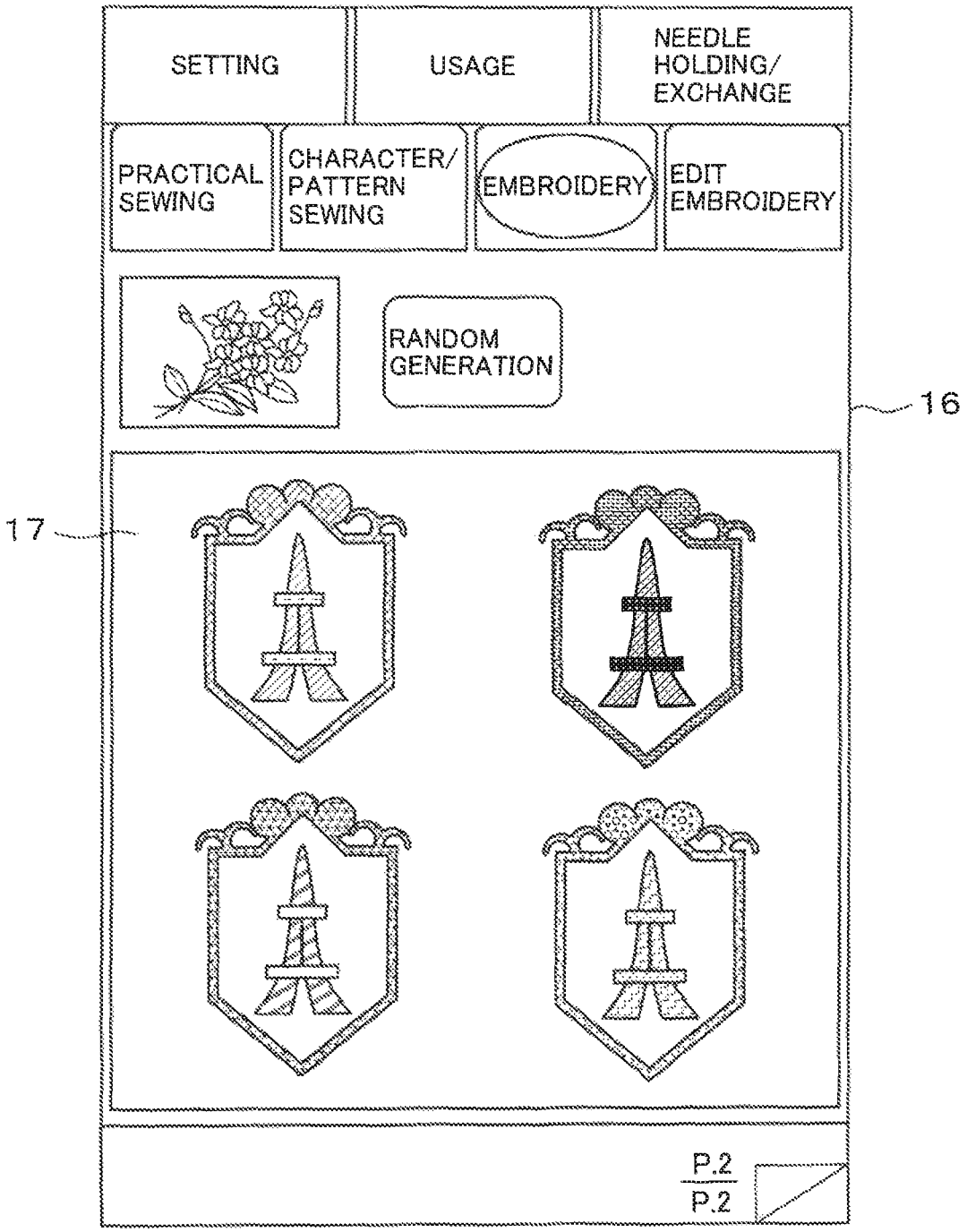
FIG. 13B is a diagram illustrating the fourth embodiment and illustrating an example of a thumbnail display of a random combination of colors.

In this case, when the user selects, for example, the combined embroidery pattern of the one-point pattern of "broadcast tower" and the frame pattern of "elongated pentagonal patch shape", then a plurality of combined embroidery patterns for which a combination of colors is randomly changed is displayed as thumbnail images on the LCD 16, as illustrated in FIG. 13B. This further allows the user to obtain combinations of combined embroidery patterns with various colors. Although not illustrated, the user may select bluish colors, greenish colors, or the like as the colors of the embroidery patterns so as to provide consistency in the similar colors, and may display a plurality of combined embroidery patterns for which a combination of colors is randomly changed.

In addition, the present disclosure is not limited to the above embodiments and can be extended or modified in various ways. For example, the above embodiments illustrate a case where a one-point pattern is selected as main data and a plurality of frame patterns is randomly combined. However, the mode in which one frame pattern is selected as main data and a plurality of one-point patterns is randomly combined may be modified in various ways. The present disclosure can be implemented by changing the mechanical structure of the sewing machine, the type of the embroidery pattern, and the like in various ways without departing from the scope of the present disclosure.

In the embodiments described above, a single CPU may perform all of the processes. Nevertheless, the disclosure may not be limited to the specific embodiment thereof, and a plurality of CPUs, a special application specific integrated circuit ("ASIC"), or a combination of a CPU and an ASIC may be used to perform the processes.

The foregoing description and drawings are merely illustrative of the principles of the disclosure and are not to be construed in a limited sense. Various changes and modifications will become apparent to those of ordinary skill in the art. All such changes and modifications are seen to fall within the scope of the disclosure as defined by the appended claims.

We claim:

1. A sewing machine that is capable of sewing a combined embroidery pattern on a work cloth on the basis of stored pattern data, the sewing machine comprising:

a storage unit configured to store a plurality of pieces of pattern data respectively corresponding to a plurality of embroidery patterns, each of the plurality of pieces of pattern data being respectively associated with condition information, the condition information:

specifying an embroidery pattern combinable with the embroidery pattern corresponding to the pattern data for which the condition information is associated; and being information for specifying a size of an embroidery pattern of the pattern data; and a controller configured to control the sewing machine to:

select one piece of pattern data from the plurality of pieces of the pattern data stored in the storage unit;

randomly extract a plurality of other pieces of the pattern data of other embroidery patterns determined to be combinable with the embroidery pattern corresponding to the selected one piece of pattern data on the basis of the condition information associated with the selected one piece of pattern data;

generate images of a plurality of combined embroidery patterns as a combination of a plurality of embroidery patterns respectively corresponding to the extracted plurality of other pieces of the pattern data and an embroidery pattern corresponding to the selected one piece of pattern data; and display the images of the generated combined embroidery patterns on a display.

2. The sewing machine according to claim 1, wherein the plurality of pieces of embroidery pattern data stored in the storage unit is classified into a plurality of types of data depending on a form of a pattern, and the controller is configured to further control the sewing machine to:

extract the plurality of other pieces of the pattern data from the stored pattern data that is classified into types other than a type into which the selected one piece of pattern data is classified.

3. The sewing machine according to claim 1, the controller being configured to further control the sewing machine to:

extract the plurality of other pieces of the pattern data when the size of the embroidery pattern of the selected one piece of pattern data is equal to or greater than a predetermined ratio with respect to a size of a combinable region in the embroidery pattern of the plurality of other pieces of the pattern data on the basis of the condition information.

4. The sewing machine according to claim 1, the controller being configured to further control the sewing machine to:

enlarge or reduce a size of an embroidery pattern of the extracted plurality of other pieces of the pattern data in accordance with the size of the embroidery pattern of the selected one piece of pattern data.

5. The sewing machine according to claim 4, the controller being configured to further control the sewing machine to:

determine whether the size of combined embroidery patterns after the enlargement exceeds a maximum size with which sewing is enabled by the sewing machine, and when the size of the embroidery pattern of the extracted plurality of other pieces of the pattern data is enlarged, and when it is determined that the size of the combined embroidery patterns exceeds the maximum size, the embroidery pattern that was enlarged is excluded from a target of extraction by the extracting.

6. The sewing machine according to claim 4, the controller being configured to further control the sewing machine to:

determine whether the size of combined embroidery patterns after the enlargement exceeds a maximum size with which sewing is enabled by the sewing machine, and when the size of the embroidery pattern of the extracted plurality of other pieces of the pattern data is enlarged in accordance with the size of the embroidery pattern of the selected one piece of pattern data, and when it is determined that the size of the combined embroidery patterns exceeds the maximum size, the embroidery pattern of the selected one piece of pattern data and the enlarged embroidery pattern are reduced.

7. A sewing machine that is capable of sewing a combined embroidery pattern on a work cloth on the basis of stored pattern data, the sewing machine comprising:

a storage unit configured to store:

a plurality of pieces of pattern data respectively corresponding to a plurality of embroidery patterns, each of the plurality of pieces of pattern data being respectively associated with condition information, the condition information:

specifying an embroidery pattern combinable with the embroidery pattern corresponding to the pattern data for which the condition information is associated; and being information indicating a category classified depending on a design of an embroidery pattern of each piece of pattern data; and a correlation between one category and a category of pattern data of an embroidery pattern combinable with an embroidery pattern of pattern data classified into the one category;

a controller configured to control the sewing machine to:

select one piece of pattern data from the plurality of pieces of the pattern data stored in the storage unit;

randomly extract a plurality of other pieces of the pattern data classified into a category corresponding to a category into which the embroidery pattern of the selected one piece of pattern data is classified;

generate images of a plurality of combined embroidery patterns as a combination of a plurality of embroidery patterns respectively corresponding to the extracted plurality of other pieces of the pattern data and an embroidery pattern corresponding to the selected one piece of pattern data; and display the images of the generated combined embroidery patterns on a display.

8. The sewing machine according to claim 7, the controller being configured to further control the sewing machine to:

display a plurality of combined embroidery patterns on one screen of the display.

9. The sewing machine according to claim 7, wherein the plurality of pieces of embroidery pattern data stored in the storage unit is classified into a plurality of types of data depending on a form of a pattern, and the controller is configured to further control the sewing machine to:

extract the plurality of other pieces of the pattern data from pattern data classified into types other than a type into which the selected one piece of pattern data is classified.

10. A non-transitory storage medium storing a computer-executable program for causing a controller of a sewing machine to perform the following functions:

accessing a plurality of pieces of stored pattern data respectively corresponding to a plurality of embroidery patterns, each of the plurality of pieces of pattern data being respectively associated with condition information, the condition information:

specifying an embroidery pattern combinable with the embroidery pattern corresponding to the pattern data for which the condition information is associated; and being information indicating a category classified depending on a design of an embroidery pattern of each piece of pattern data; and accessing a stored correlation between one category and a category of pattern data of an embroidery pattern combinable with an embroidery pattern of pattern data classified into the one category;

selecting one piece of pattern data from the plurality of pieces of the pattern data stored in the storage unit;

randomly extracting a plurality of other pieces of the pattern data classified into a category corresponding to a category into which the embroidery pattern of the selected one piece of pattern data is classified;

generating images of a plurality of combined embroidery patterns as a combination of a plurality of embroidery patterns respectively corresponding to the extracted plurality of other pieces of the pattern data and an embroidery pattern corresponding to the selected one piece of pattern data; and displaying the images of the generated combined embroidery patterns on a display.

11. The non-transitory storage medium according to claim 10, wherein:

the plurality of pieces of embroidery pattern data stored in the storage unit is classified into a plurality of types of data depending on a form of a pattern; and the program further causes the controller to perform the function of extracting the plurality of other pieces of the pattern data from pattern data classified into types other than a type into which the selected one piece of pattern data is classified.

12. The non-transitory storage medium according to claim 10, wherein the program further causes the controller to perform the function of displaying a plurality of combined embroidery patterns on one screen of the display.

* * * * *